US005133254A

United States Patent [19]

Kirkwood

[11] Patent Number: 5,133,254

[45] Date of Patent: Jul. 28, 1992

[54] QUILT GUIDE STAMP KIT APPARATUS

[76] Inventor: Christine A. Kirkwood, P.O. Box 94, Riverside, Iowa 52327

[21] Appl. No.: 619,501

[22] Filed: Nov. 29, 1990

[51] Int. Cl.[5] ..... B41F 17/00

[52] U.S. Cl. ..... 101/372; 101/373; 101/405; 101/399; 101/333; 101/327

[58] Field of Search ..... 101/333, 368, 327, 405, 101/397, 399, 403, 406, 372, 3; 33/561.1, 561.2, 567, 567.1

[56] References Cited

U.S. PATENT DOCUMENTS

| | | | |
|---|---|---|---|
| 167,621 | 9/1875 | Robinson | 101/368 |
| 1,780,036 | 10/1930 | Padgett | 33/561.1 X |
| 2,159,697 | 5/1939 | Hardy | 101/368 |
| 3,442,209 | 5/1969 | Funahasi | 101/327 |
| 3,631,799 | 1/1972 | Funahasi | 101/327 |
| 4,497,275 | 2/1985 | Johnson et al. | 118/268 |
| 4,594,943 | 6/1986 | Nettesheim et al. | 101/327 |
| 4,676,162 | 6/1987 | Phipps, Sr. et al. | 101/405 |
| 4,814,218 | 3/1989 | Shane | 428/102 |

FOREIGN PATENT DOCUMENTS

| | | | |
|---|---|---|---|
| 2115088 | 12/1972 | Fed. Rep. of Germany | 101/368 |
| 443479 | 9/1912 | France | 101/372 |
| 2376749 | 9/1978 | France | 101/368 |
| 184871 | 3/1984 | Japan | 101/368 |
| 22711 | 10/1913 | United Kingdom | 101/368 |

*Primary Examiner*—Edgar S. Burr
*Assistant Examiner*—Eric P. Raciti
*Attorney, Agent, or Firm*—Leon Gilden

[57] ABSTRACT

A kit for imparting a geometric pattern onto a fabric to impart a desired mark as provided. The patterns are utilized for quilting a final design on a cloth quilt. The organization includes a stamp in cooperation with a knee pad, wherein the stamp includes a body with a geometric pattern mounted thereon. A modification of the invention includes a stamp body permitting mounting of various patterns theron.

1 Claim, 4 Drawing Sheets

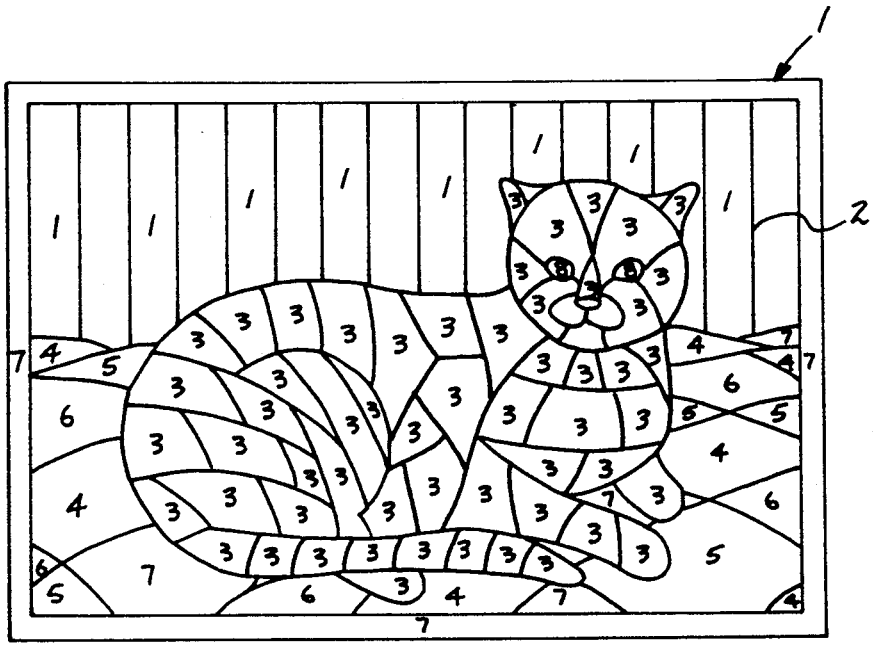
Fig 1
PRIOR ART
Fig 2
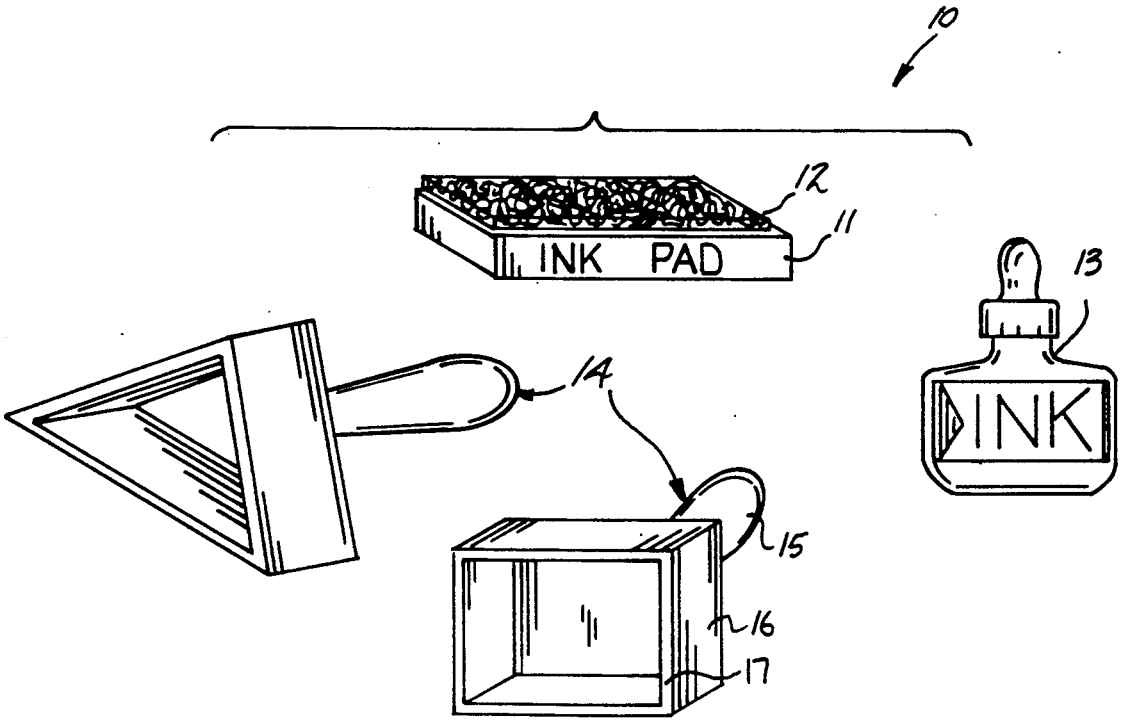

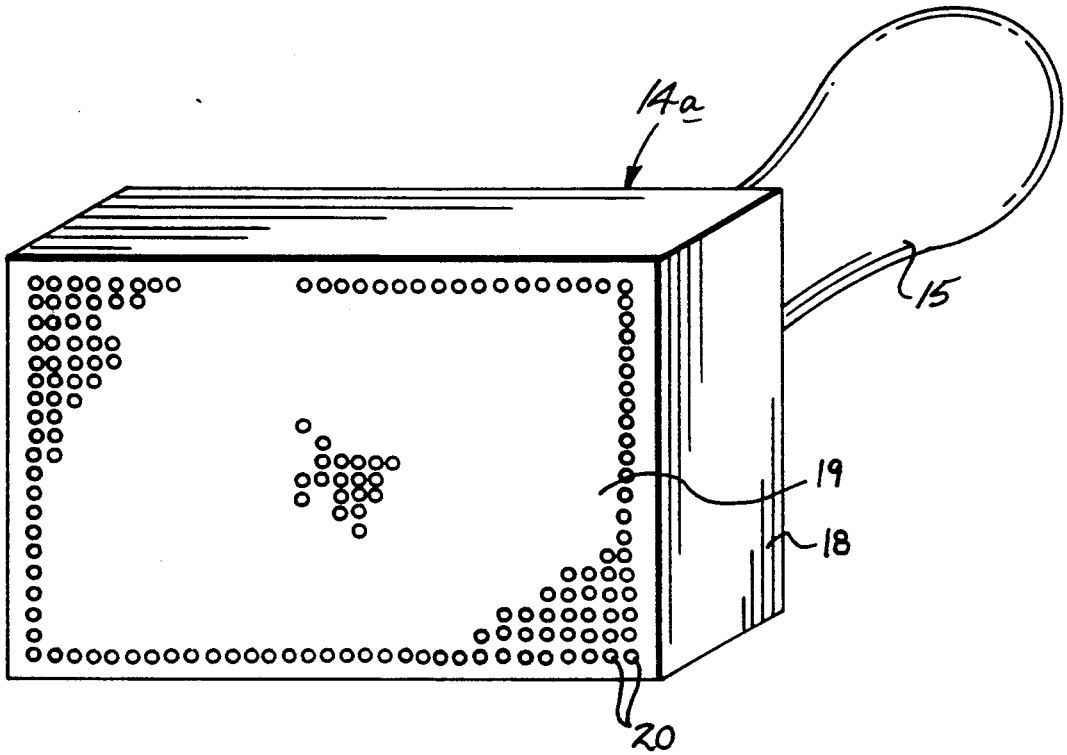
Fig 3
Fig 4
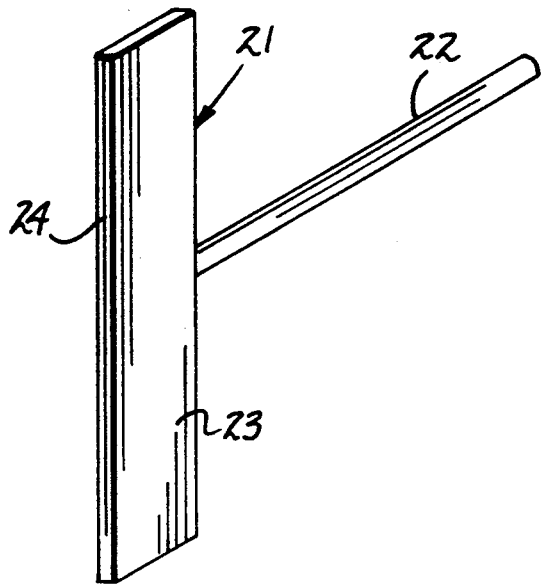

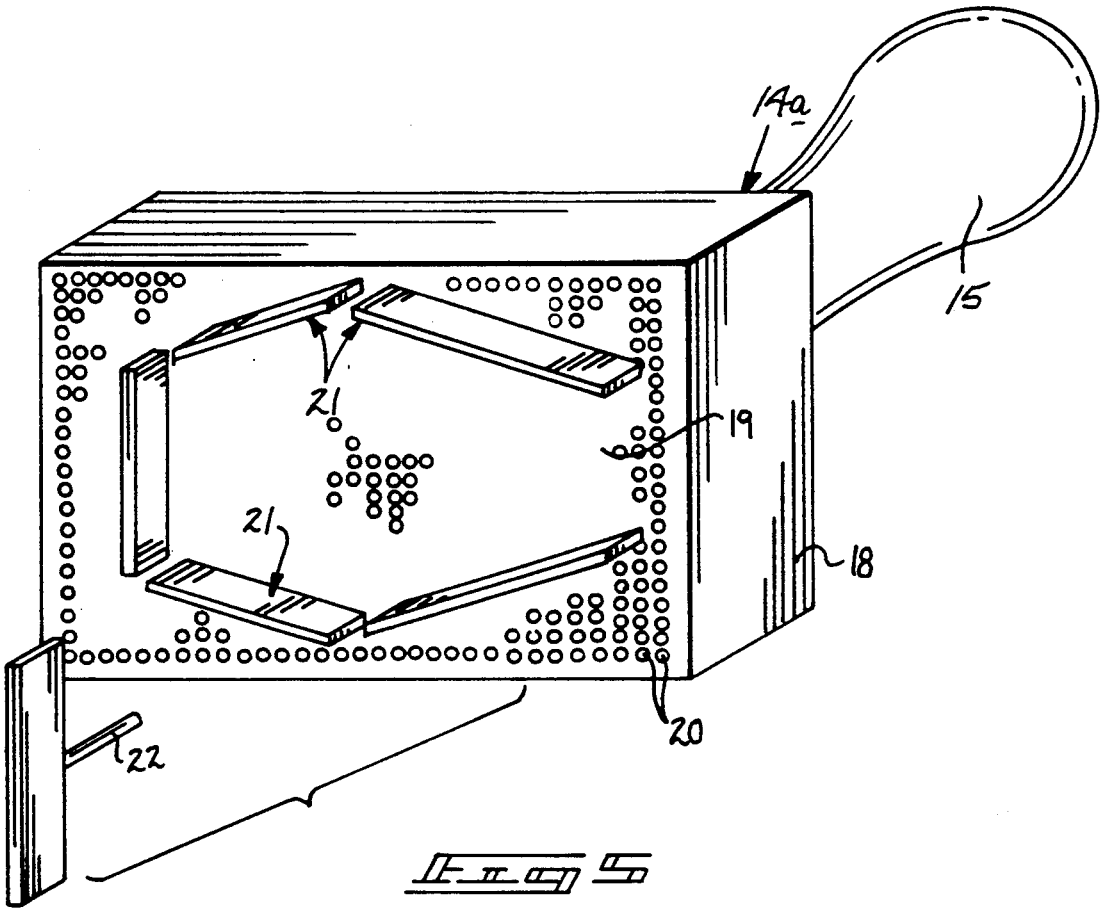
Fig 5
Fig 6
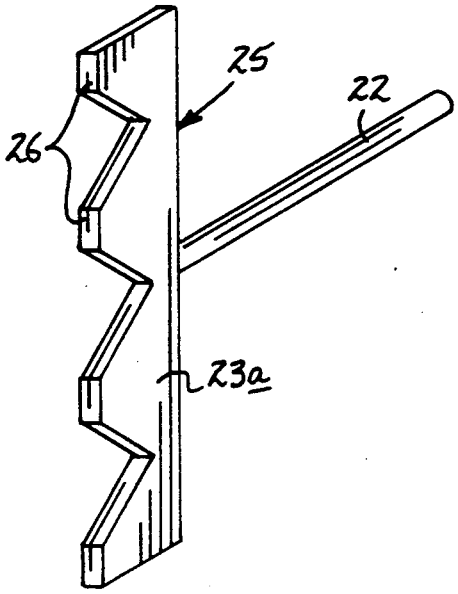

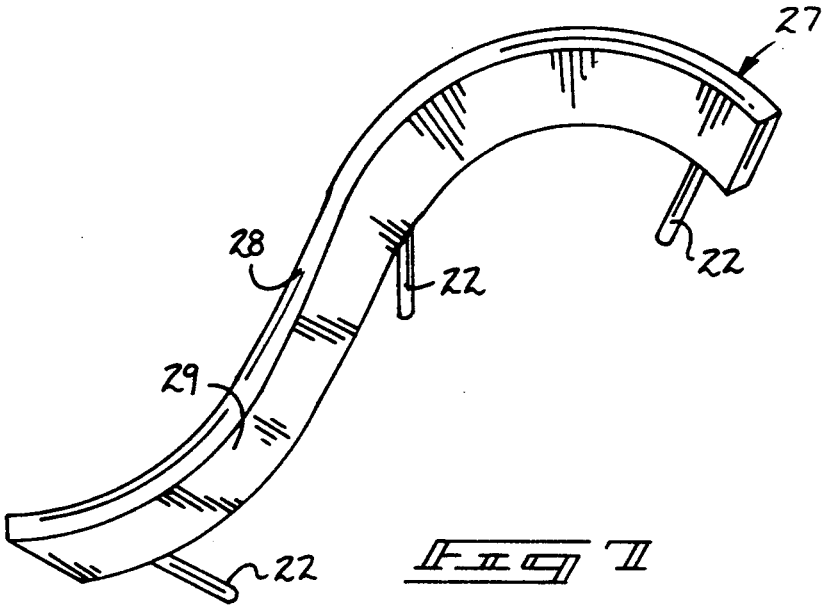
Fig 7
Fig 8
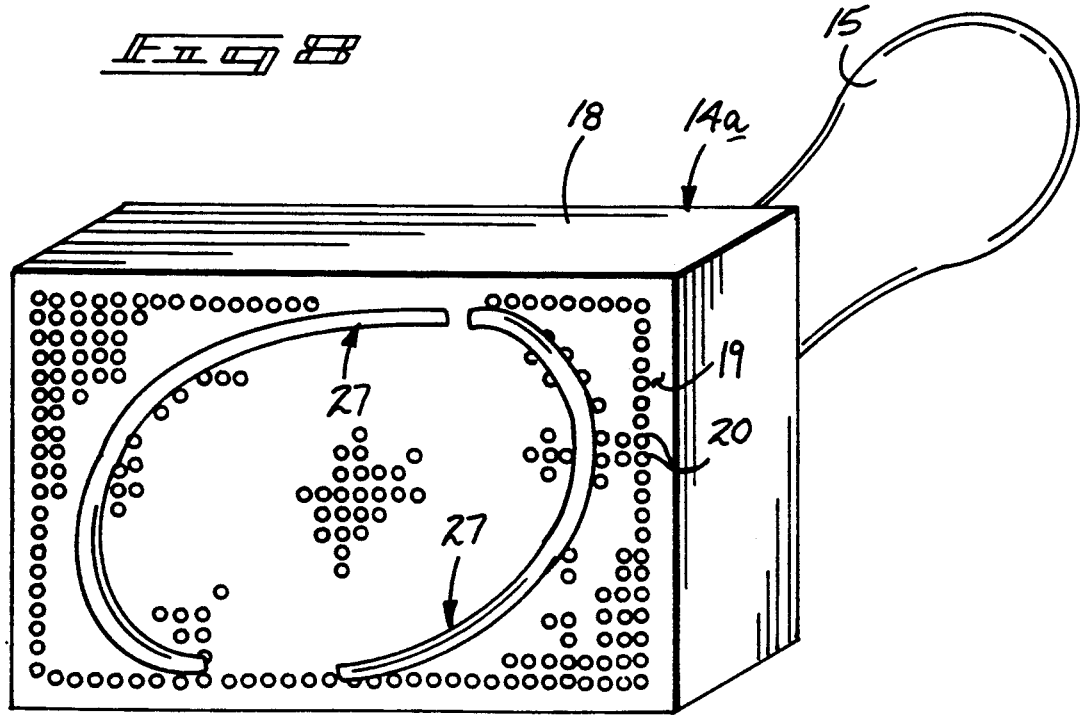

QUILT GUIDE STAMP KIT APPARATUS

BACKGROUND OF THE INVENTION

1. Field of the Invention

The field of invention relates to quilting apparatus, and more particularly pertains to a new and improved quilt guide stamp kit apparatus wherein the same is arranged for imparting desired geometric patterns onto fabric to be quilted.

2. Description of the Prior Art

Typically, imparting patterns onto quilting fabric is effected by utilizing a rule and pencil type method. The instant invention attempts to overcome deficiencies of the prior art by imparting a pattern in a convenient manner utilizing a stamping arrangement. Examples of the prior art include U.S. Pat. No. 4,814,218 to Shane wherein a quilting kit utilizes slits cut into a substrate along lines defining a desired pattern.

U.S. Pat. No. 4,594,943 to Nettesheim, et al. sets forth an ink stamp with a die reciprocatably mounted within a housing.

U.S. Pat. No. 4,497,275 to Johnson, et al. sets forth an ink stamp pad and reservoir defining a particular construction of the pad.

U.S. Pat. No. 4,676,162 to Phipps, Sr., et al. sets forth a stamp pad mounting a stamping press interiorly of the stamp body reciprocatably therewithin.

As such, it may be appreciated that there continues to be a need for a new and improved quilt guide stamp kit apparatus as set forth by the instant invention which addresses both the problems of ease of use as well as effectiveness in construction and in this respect, the present invention substantially fulfills this need.

SUMMRY OF THE INVENTION

In view of the foregoing disadvantages inherent in the known types of quilting apparatus now present in the prior art, the present invention provides a quilt guide stamp kit apparatus wherein the same provides a plurality of stamps utilizing various geometric patterns to impart such patterns on a fabric substrate as a quilting guide. As such, the general purpose of the present invention, which will be described subsequently in greater detail, is to provide a new and improved quilt guide stamp kit apparatus which has all the advantages of the prior art quilting apparatus and none of the disadvantages.

To attain this, the present invention provides a kit for imparting a geometric pattern onto a fabric to impart a desired mark as provided. The patterns are utilized for quilting a final design on a cloth quilt. The organization includes a stamp in cooperation with a knee pad, wherein the stamp includes a body with a geometric pattern mounted thereon. A modification of the invention includes a stamp body permitting mounting of various patterns thereon.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this dislcosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved quilt guide stamp kit apparatus which has all the advantages of the prior art quilting apparatus and none of the disadvantages.

It is another object of the present invention to provide a new and improved quilt guide stamp kit apparatus which may be easily and efficiently manufactured and marketed.

It is a further object of the present invention to provide a new and improved quilt guide stamp kit apparatus which is of a durable and reliable construction.

An even further object of the present invention is to provide a new and improved quilt guide stamp kit apparatus which is susceptible of a low cost of manufacture with regard to both materials and labor, and which accordingly is then susceptible of low prices of sale to the consuming public, thereby making such quilt guide stamp kit apparatus economically available to the buying public.

Still yet another object of the present invention is to provide a new and improved quilt guide stamp kit apparatus which provides in the apparatuses and methods of the prior art some of the advantages thereof, while simultaneously overcoming some of the disadvantages normally associated therewith.

Still another object of the present invention is to provide a new and improved quilt guide stamp kit apparatus wherein the same sets forth a stamping arrangement utilizing a plurality of stamps including stamping members with deformable blades mounted thereon to provide patterns of various configurations.

These together with other objects of the invention, along with the various features of novelty which characterize the invention, are pointed out with particularlity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a top orthographic view of a prior art quilt guide apparatus.

FIG. 2 is an isometric illustration of the instant invention.

FIG. 3 is an isometric illustration of a modified stamp member utilized by the instant invention.

FIG. 4 is an isometric illustration of a blade assembly utilized by the stamp as set forth in FIG. 3.

FIG. 5 is an isometric illustration of a plurality of blade assemblies mounted to the stamp member.

FIG. 6 is an isometric illustration of a further blade assembly utilized by the instant invention.

FIG. 7 is an isometric illustration of a flexible blade assembly utilized by the instant invention.

FIG. 8 is an isometric illustration of the flexible blade assembly mounted to the stamp body.

DESCRIPTION OF THE PREFERRED EMBODIMENT

With reference now to the drawings, and in particular to FIGS. 1 to 8 thereof, a new and improved quilt guide stamp kit apparatus embodying the principles and concepts of the present invention and generally designated by the reference numeral 10 will be described.

FIG. 1 illustrates a prior art quilt guide apparatus 1, wherein various slits 2 are mounted within the substrate to effect a quilting guide arrangement for use, in a manner as set forth in U.S. Pat. No. 4,814,218.

More specifically, the quilt guide stamp kit apparatus 10 of the instant invention essentially comprises an ink pad assembly 11, including a base with an ink pad layer 12 mounted therewithin. A refill ink bottle container 13 is provided, as well as a plurality of stamp members 14. The stamp members 14 each include an axially aligned handle 15 orthogonally mounted to a stamp body 16. Each stamp body 16 includes an ink imparting edge 17 to effect and impart a geometric pattern onto a fabric quilt substrate once the edge 17 has been pre-inked by contact with the pad layer 12 soaked with the ink from the container 13.

FIG. 3 illustrates a modified stamp member 14*a*, with a modified ink body 18 formed of a polymeric material of a generally parallelepiped configuration defined by a predetermined thickness. The body 18 incudes a planar bottom surface 19 and is orthogonally oriented relative to the axially aligned handle 15, wherein the inked body 18 is defined by a predetermined thickness as measured in alignment with the axial aligned handle 15. The planar bottom surface 19 includes a maxtrix of apertures 20 coextensively directed through the surface 19 orthogonally relative to the bottom surface for receiving in a frictional retentive manner a blade assembly rod 22 of a blade assembly 21. Each blade assembly rod 22 is defined by a predetermined length substantially equal to the predetermined thickness and is defined by a rod diameter substantially equal to a predetermined aperture diameter defined by each aperture of the apertures 20. Each rod 22 is orthogonally oriented and integrally mounted to an elongate blade body 23. The blade body 23 includes a blade edge 24 that is directed into the pad layer 12 for receiving a predetermined quantity of ink thereon for imparting to a fabric quilting substrate.

FIG. 5 illustrates a matrix of blade assemblies 21 mounted to the bottom surface 19. FIG. 6 illustrates the use of a further blade assembly 25 defining a plurality of spaced blade edges 26 that are mounted on spaced projections defining the modified blade body 23*a*. As required, the blade assembly rod 22 is orthogonally mounted to a top edge of the blade body 23*a* spaced from the blade edges 26.

FIG. 7 illustrates a flexible blade assembly 27, including a flexible blade body 29 formed of a memory retentent (or shape retentive) material. The blade body 29 may be configured as desired, with a plurality of rigid support rods 22 orthogonally mounted to the top edge of the flexible blade assembly 27 spaced from the flexible ink receiving bottom edge 28. In this manner, a desired geometric pattern may be imparted to a fabric and mounted upon the bottom surface 19 as desired.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A quilt guide stamp kit apparatus comprising, in combination, an ink pad assembly, including a support base and an ink absorbent pad layer mounted overlying the base, and an ink fluid reservoir arranged for replenishing the pad layer, and a plurality of stamp members, each stamp member including an axially aligned handle and a stamp body, the handle integrally and orthogonally mounted to a top surface of the stamp body medially thereof, and the stamp body including an ink imparting edge mounted to a bottom surface of the stamp body, and wherein the stamp body includes a planar bottom surface orthogonally arranged relative to the handle, and the planar bottom surface including a matrix of apertures orthogonally directed into the planar bottom surface and the matrix of apertures coextensive with the bottom surface, and the ink imparting edge including a blade assembly selectively mounted within the planar bottom surface, each blade assembly including an elongate blade body, and at least one rod fixedly and orthogonally mounted to a top edge of the blade body, and the stamp body defined by a predetermined thickness, and the rod defined by a predetermined length substantially equal to the predetermined thickness, and the rod further defined by a rod diameter and each aperture of the matrix of apertures defined by a predetermined aperture diameter, wherein the rod diameter is substantially equal to the predetermined aperture diameter, and including a plurality of blade assemblies arranged for reception within the planar bottom surface defining a predetermined geometric configuration, and including at least one further blade assembly, wherein the further blade assembly defines a blade body with a top edge orthogonally and integrally mounting at least one rod and the bottom edge defined by spaced blade edges mounted on spaced body projections, and wherein the kit further includes a plurality of flexible blade assemblies, each blade assembly including an elongate flexible blade body formed of a shape retentive material, and each flexible blade body including a plurality of said rigid rods fixedly and orthogonally mounted to a top edge of the flexible blade body, and the flexible blade body including an elongate flexible blade edge, wherein at least one flexible blade body is arranged for mounting on the planar bottom surface to form a desired geometric configuration.

* * * * *